US006371599B1

(12) United States Patent
Hotomi et al.

(10) Patent No.: US 6,371,599 B1
(45) Date of Patent: Apr. 16, 2002

(54) INK JET RECORDING APPARATUS AND DRIVE UNIT AND METHOD FOR INK JET HEAD

(75) Inventors: Hideo Hotomi, Nishinomiya; Kusunoki Higashino, Osaka; Masaki Asano, Nishinomiya; Yasuhisa Fujii, Kyoto, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/295,644

(22) Filed: Apr. 20, 1999

(30) Foreign Application Priority Data

Apr. 27, 1998 (JP) ..... 10-116707
Apr. 28, 1998 (JP) ..... 10-119439

(51) Int. Cl.[7] ..... B41J 2/04
(52) U.S. Cl. ..... 347/54
(58) Field of Search ..... 347/54, 68, 69, 347/70, 71, 50, 40, 14, 10, 86, 5, 11, 20; 399/261; 361/700; 29/890.1; 310/328–330

(56) References Cited

U.S. PATENT DOCUMENTS 5,975,668 A * 11/1999 Fujii et al. ..... 347/10
5,980,013 A * 11/1999 Takahashi et al. ..... 347/14

FOREIGN PATENT DOCUMENTS

| | | |
|---|---|---|
| JP | 7-214770 | 8/1995 |
| JP | 7-214780 | 8/1995 |
| JP | 8-072237 | 3/1996 |
| JP | 8-267744 | 10/1996 |

* cited by examiner

*Primary Examiner*—Raquel Yvette Gordon
(74) *Attorney, Agent, or Firm*—Sidley Austin Brown & Wood

(57) ABSTRACT

The present invention relates to an ink jet recording apparatus using an electrostatic actuator. The present invention provides an ink jet recording apparatus comprising a resilient oscillating plate that is facing a pressure chamber that communicates with a nozzle, a first electrode provided on said oscillating plate, a second electrode opposing said first electrode across a space, and a voltage application unit that applies across the first electrode and the second electrode a first voltage that causes the ink in said pressure chamber to be ejected and a second voltage that does not cause the ink to be ejected, wherein said second voltage is applied a specified time prior to the application of the first voltage, so that the residual electrical charges on the first electrode and/or the second electrode can be positively discharged.

34 Claims, 10 Drawing Sheets

32

INK JET RECORDING APPARATUS AND DRIVE UNIT AND METHOD FOR INK JET HEAD

This application is based on application Nos. 10-116707 and 10-119439 filed in Japan, the contents of which are hereby incorporated by reference.

BACKGROUND OF THE INVENTION

1. Field of the Invention

The present invention relates to an ink jet recording apparatus based on an electrostatic actuator and a drive unit and method for an ink jet head.

2. Description of the Prior Art

Some of the ink jet heads for ink jet recording apparatuses use electrostatic actuators.

The ink jet head based on the electrostatic jet head comprises an oscillating plate provided in a pressure chamber that communicates with an ink injecting nozzle, an electrode (herein called a first electrode) provided on the oscillating plate, and a second electrode provided opposing the first electrode across a slight space, wherein the pressure of ink filled in the pressure chamber is altered by means of deforming the oscillating plate with an electrostatic force generated between the first electrode and the second electrode by applying an electric voltage across the two electrodes, thus causing the ink to be ejected from the nozzle to fly and land on a recording medium to form an image there.

Such a drive unit for the ink jet head based on the electrostatic actuator is essentially a unit for applying a voltage across the first and second electrodes, wherein the unit applies a voltage across the two electrodes to cause the oscillating plate of the electrostatic actuator to deform in a direction of expanding the pressure chamber and, when the voltage applied across the two electrodes is abruptly cut off, the oscillating plate restores to the original position of the oscillating plate thus creating a pressure rise in the pressuring chamber to cause an ink drop to be ejected from the nozzle.

A problem with such an ink jet head drive unit has been that a certain electric charge remains between the first and second electrodes after the voltage is applied and cause image fluctuations.

This is due to the fact that the amount of the electric charge remaining on the electrodes typically varies depending on whether the ink jet head is continuously operated or sporadically operated in ejecting ink drops from the ink jet head, as they cause a different amount of deformation to the oscillating plate even if the applied voltage is the same.

Moreover, even if the ink jet head is operated continuously, polarization occurs after a while in dielectric members existing in the second electrode or the oscillating plate as a result of the DC voltage applied across the electrodes for a prolonged period of time, consequently causing fluctuations in the amount of ink ejection and the ejection speed.

These problems can be more conspicuous when the oscillating plate is made of a semiconductor material.

Several techniques have been invented to prevent these problems of the residual electric charge and polarization and disclosed, for example, in Japanese Laid-Open Publication Hei 7-214770, Hei 8-72237, Hei 8-267744, and Hei 7-214780.

The technique disclosed in Japanese Laid-Open Publication Hei 7-214770 is to prevent the accumulation of the electric charge by applying a voltage for a certain period of time across the oscillating plate and an individual electrode by means of a charging circuit, and causing ink to fly by means of abruptly discharging the charge stored through a discharging circuit.

The technique disclosed in Japanese Laid-Open Publication Hei 8-72237 is to prevent the accumulation of the electric charge by shorting the high potential side and the low potential side of the power source when the head is not operating.

The technique disclosed in Japanese Laid-Open Publication Hei 8-267744 is to improve the printing quality by means of suppressing unnecessary ink release or fluctuations of ink drop diameters due to cross talk by means of constituting a system in such a way that a piezoelectric member deforms in a directions along the ink chamber when a voltage is applied by a voltage application means as the piezoelectric member is affixed only on a separating wall via an adhesive layer.

The technique disclosed in Japanese Laid-Open Publication Hei 7-214780 is to cancel the remaining polarization by applying a voltage in the forward direction between the oscillating plate and an individual electrode when the system is printing, and applying a voltage between the oscillating plate and the individual electrode in the backward direction when the system is not printing.

However, it has been learned that the residual electric charges cannot be completely erased within the operating cycle of the ink jet head by simply grounding the electrodes or shorting between the first and second electrodes during the non-operating period in consideration of the operating cycle of the ink jet head, i.e., the period from one printing operation to the next in the ink jet head recording apparatus.

This is due to the structure of the ink jet head particularly to the electrode unit that causes the oscillating plate to operate.

Since the oscillating plate of the ink jet head that uses the electrostatic actuator is manufactured by the micromachine technology based on the semiconductor device manufacturing process, the oscillating plate and the first electrode provided on the oscillating plate are both made of silicon substrates, and the surface of the first electrode is covered with an insulating film in order to prevent shorting between the first and second electrodes when they accidentally come into contact. Consequently, the oscillating plate area has electrostatic an capacity caused by barrier areas developed in the semiconductor and the insulating film, thus leaving a residual electric charge accumulated by the voltage applied during the operation. In order to eliminate this residual electric charge, it is necessary to discharge the electrostatic capacity, and the time required for this discharge depends on the time constant of the electrostatic capacity, so that the discharge requires as much time as approximately 1.014 sec if an oxide film is formed as the insulation film because of the high dielectric constant of the oxide film (the time T is calculated as $T=\in^{RC}$, where $\in=4$, $R=1\times10^{10}$, $c=1\times10^{-12}$).

In various types of ink jet type printers (not only those using electrostatic actuators), the operating cycle time is from 250 to 500 micro seconds at the most when they are printing continuously using one ink jet head, so that the operating time is much shorter than the time required for erasing the residual electric charge, consequently making it impossible to erase the residual charge completely when the system is printing continuously.

As a consequence, since the degree of the residual electrical charge varies depending on whether the time between one printing to the next is longer or shorter, the amount of deformation of the oscillating plate due to the application of the drive voltage varies, resulting in fluctuations of the amount of ink ejected and the density or dot size of each printed pixel, hence fluctuations of images. This problem has not yet been completely solved.

The phenomenon remains the same even if the first and second electrodes are short-circuited in the non-operating course as was disclosed by mentioned above, and the residual electrical charge cannot be erased completely within the non-operating time in case of a continuous printing process, so that the amount of the remaining charge on the electrodes varies with the length of the non-operating time and the image deterioration problem associated with the residual charge cannot be solved.

SUMMARY OF THE INVENTION

The first objective of the present invention is to provide an ink jet head recording apparatus that can prevent image deterioration due to the residual electrical charges on the first electrode and/or the second electrodes.

The second objective of the present invention is to provide a drive unit and method for an ink jet head that can drive the ink jet head such as the one described above.

The third objective of the present invention is to provide a drive unit and method for an ink jet head that can prevent image deterioration due to polarization of the first electrode and/or the second electrodes.

The present invention provides an ink jet recording apparatus comprising a resilient oscillating plate that is facing a pressure chamber that communicates with a nozzle, a first electrode provided on the oscillating plate, a second electrode opposing the first electrode across a space, and a voltage application unit that applies across the first electrode and the second electrode a first voltage that causes the ink in the pressure chamber to be ejected and a second voltage that does not cause the ink to be ejected, wherein the second voltage is applied a specified time prior to the application of the first voltage, so that the residual electrical charges on the first electrode and/or the second electrode can be positively discharged.

The ink jet recording apparatus further comprises a humidity detector, so that the specified time can be determined according to the humidity measured so that the effect of the fluctuation of the residual electrical charges of the first electrode and/or the second electrode depending on the humidity can be properly addressed.

The present invention provides a drive unit for an ink jet head comprising a drive voltage controller that applies a pulse-like drive voltage that causes the ink to be ejected across the oscillating plate and the second electrode, and an AC voltage controller that applies an AC voltage across the oscillating plate and the second electrode while the drive voltage is not applied, wherein the intensity of the AC voltage is not high enough to cause the ink ejection and the frequency of the AC voltage is larger than the frequency of the pulse-like drive voltage. The occurrence of the polarization of the first and/or the second electrodes is actively prevented by applying such an AC voltage across the oscillating plate and the second electrode when the driving voltage is not applied.

DETAILED DESCRIPTION OF THE PREFERRED EMBODIMENTS

Figure 1:
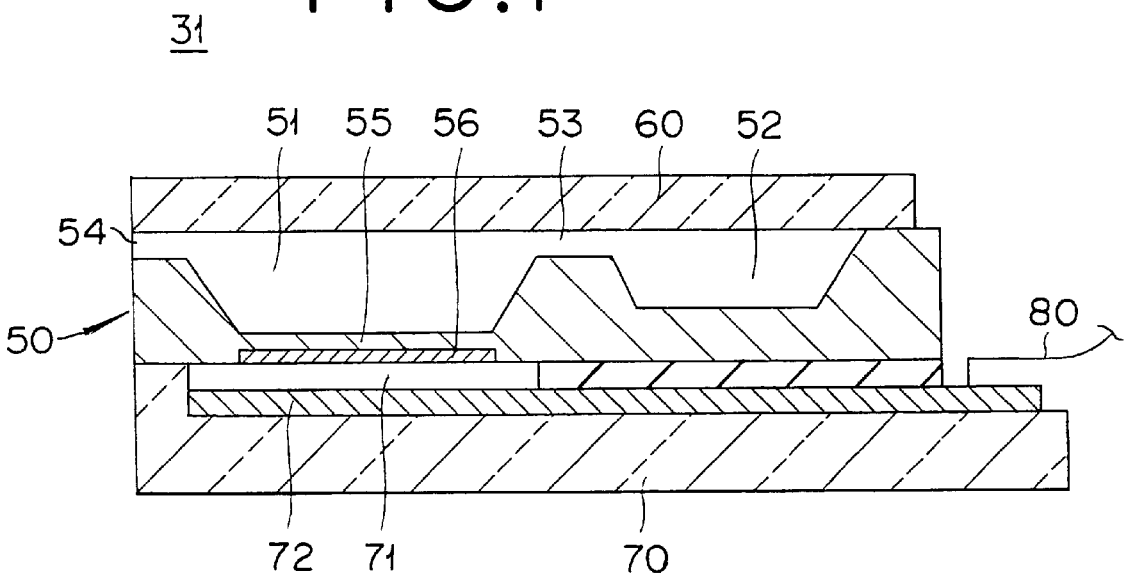
FIG. 1 is a cross section showing an ink jet head of the first embodiment of the present invention.

Let us now describe embodiments of the present invention in detail referring to the drawings.

[First Embodiment]

FIG. 1 is a cross section showing an ink jet head of the first embodiment of the present invention.

The ink jet head 31 comprises a nozzle 54 provided on a side surface, a pressure chamber 51 equipped with an oscillator plated 55 for changing the inner pressure of the ink jet head 31 so that the ink jet head 31 can eject ink through the nozzle 54, an ink supply chamber 52 that stores ink to be supplied to the pressure chamber 51, an inlet 53 for guiding the ink from the ink supply chamber 52 to the pressure chamber 51, and a drive electrode 72, which is the second electrode, that opposes the first electrode 56, which is provided on the oscillating plate 55, across a space 71.

The space 71 located between the first electrode 56 and the second drive electrode 72 has a thickness of 0.3 $\mu$m in this first embodiment. The first electrode 56 provided on the oscillating plate 55 is an impurity electric-conductive layer formed by diffusing boron. A voltage from the drive circuit is applied by means of a wire 80 on the drive electrode 72.

The voltage applied across the first electrode 56 and the driving electrode 72 causes the oscillating plate 55 to deform thus causing the pressure in the pressure chamber 51 to change, and the ink drop to be ejected through the nozzle 54.

FIG. 2 is a diagram showing the movement of the oscillating plate 55 when the oscillating plate 55 causes an ink drop to be ejected.

Figure 2A:
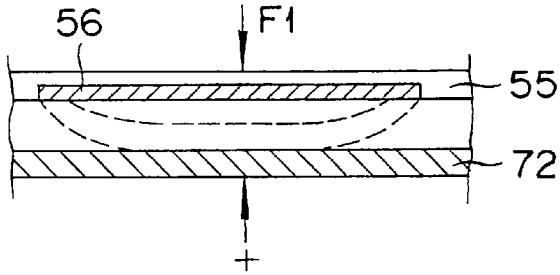
FIGS. 2A and B are diagrams showing the movement of an oscillating plate when the oscillating plate causes an ink drop to be ejected.

In order to eject an ink jet to be ejected, a voltage (preliminary voltage) is applied across the first electrode 56 and the drive electrode 72 that is not as intense as to cause the ink to be ejected within a specified time immediately prior to the application of the drive voltage. Then, a drive voltage is applied sufficient to eject ink across the first electrode 56 and the drive electrode 72, attracting the oscillation plate 55 toward the drive electrode 72 as shown in FIG. 2A by the electrostatic force generated by the application of the drive voltage. The oscillating plate 55 elastically deforms toward the driving electrode 72 as shown by dotted lines in the drawing. At this time, the ink in the ink supply chamber 52 flows into the pressure chamber 51 through the inlet 53.

As the first electrode 56 formed on the oscillating plate 55 is grounded in this first embodiment, the drive voltage applied a positive potential to the drive electrode 72. A force F1 that acts on the oscillating plate 55 because of this drive voltage can be calculated as:

$$F1=\frac{1}{2}\cdot\{\in_r\cdot\in_o\cdot S\cdot(V/d)^2\}$$

where $\in_r$ is dielectric constant of vacuum between the first electrode and the second electrode (drive electrode), $\in_o$ is the dielectric constant, S is the area of the electrode, V is the drive voltage, and d is the distance between the first electrode and the second electrode (drive electrode).

Figure 2B:
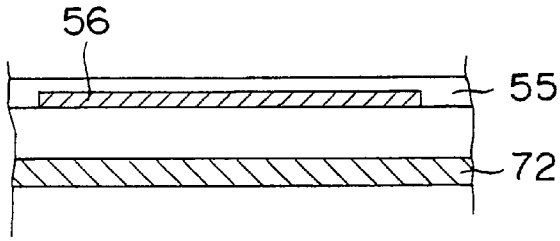

The oscillating plate 55 returns to the original position as shown in FIG. 2B due to the restoring force of the oscillating plate 55 itself when the drive voltage is abruptly cut off, increasing the internal pressure of the pressure chamber 51 to cause an ink drop to be ejected from the nozzle 54.

Thus, by applying a certain voltage as the preliminary voltage prior to the application of the drive voltage for ink ejection, the first electrode 56 will accumulate a certain electric charge on the electrode constantly prior to the application of the drive voltage and that electric charge is the same regardless of the length of the non-operating time from one printing to the next. As a consequence, the amount of ink drop ejected and the ejection speed can be made constant regardless of the operating history of the ink jet head. Therefore, the thickness and size of the printed dot remain the same to recreate good images.

Next, let us describe a drive circuit of the ink jet head that controls the deformation operation of the oscillating plate 55.

Figure 3:
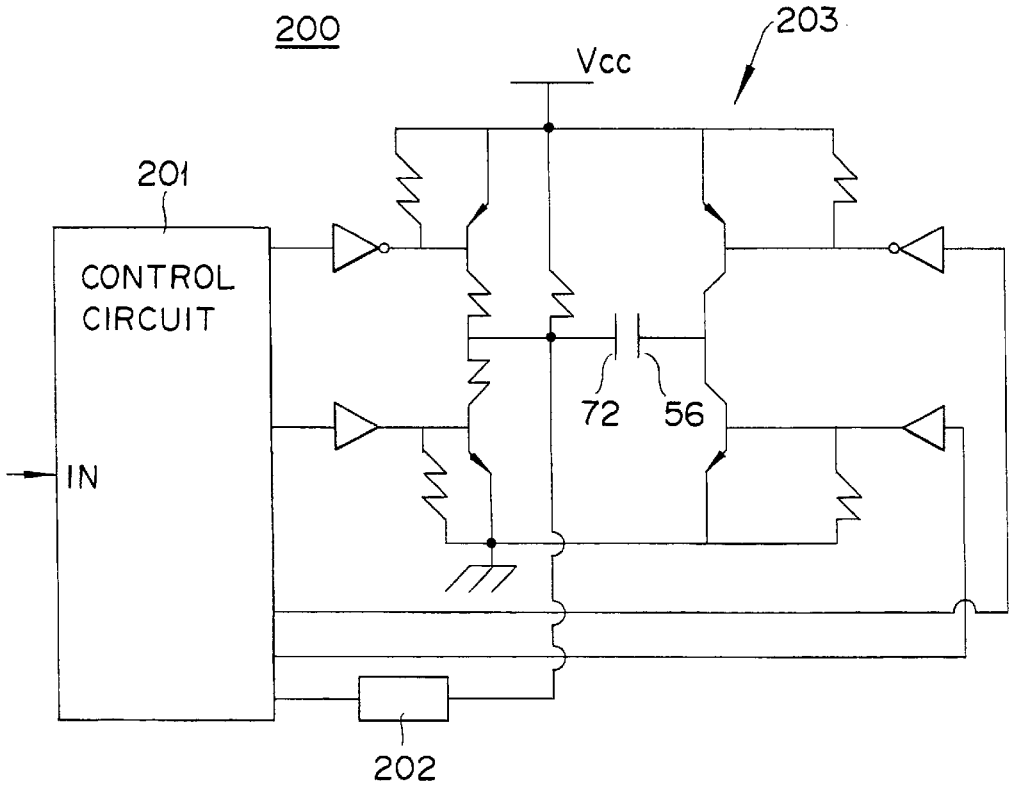
FIG. 3 is a constitutional diagram of a drive circuit for the ink jet head.

FIG. 3 is the constitutional diagram of the drive circuit of the ink jet head.

This drive circuit 200 functions as a voltage application unit that applies a voltage across the first electrode 56 and the drive electrode 72, which is the second electrode, and comprises a first voltage application unit that generates a drive voltage (first voltage) to be applied on the drive electrode 72 to operated the oscillating plate 55 of the ink jet, and a second voltage application unit that generates a preliminary voltage (second voltage) to be applied on the drive electrode 72 immediate prior to the drive voltage application.

The constitution of this drive circuit 200 comprises, as shown in FIG. 3, a control circuit 201 that controls the overall drive circuit and the application timing for the aforementioned drive voltage and the preliminary voltage, a pre-pulse generating circuit 202 that generates the preliminary voltage, or the second voltage, and an amplifying circuit 203 that is constituted as an existing amplifying circuit that consists of operational amplifiers, transistors, resistors, etc. The first electrode 56 and the drive electrode 72 are shown as capacitors here.

Figure 4:
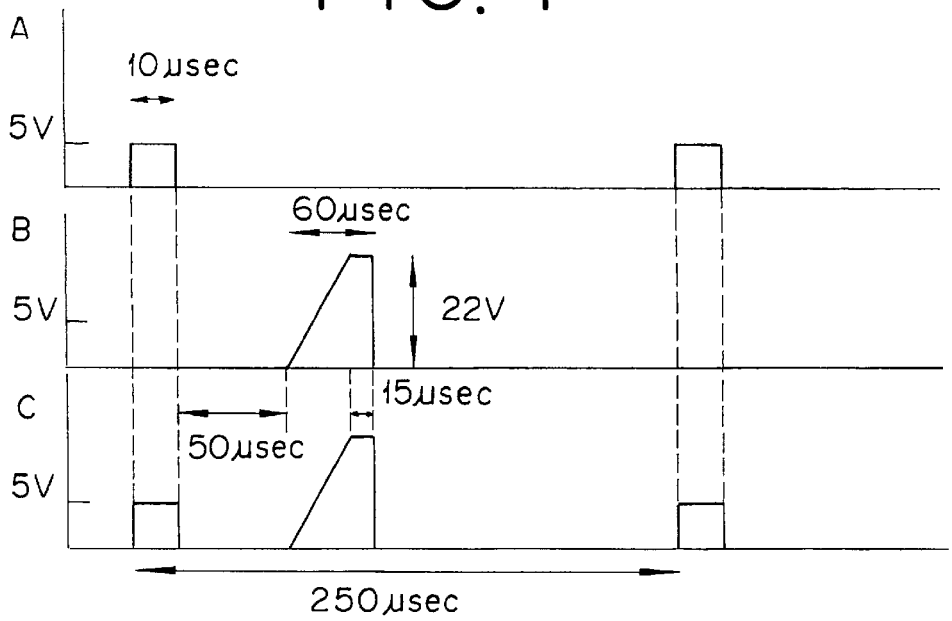
FIG. 4 is a diagram for describing the output waveform of the output from the drive circuit shown in FIG. 3.

Let us now describe the operation of the drive circuit 200 referring to output waveforms of various parts shown in FIG. 4.

First of all, when a print control signal, which is the signal for printing ink dots on the recording media, is supplied to the IN terminal of the control circuit 201, the control circuit detects the print control signal pulse and instructs the pre-pulse generating circuit 202 to generate the pre-pulse, i.e. preliminary voltage. As a result, the pre-pulse generating circuit 202 generates a predetermined pre-pulse of a predetermined voltage and applies it straight to the drive electrode 72 as shown in FIG. 4A.

In the control circuit 201, which detects the print control signal pulse, activates the built-in timer to generate the drive voltage after a certain time period, and this drive voltage is amplified by the amplifying circuit 203 eventually to become the drive voltage with a waveform as shown in FIG. 4B to be applied to the drive electrode 72. The waveform of the drive voltage applied at this time has a pulse shape that gradually rises and sharply drops as shown in FIG. 4B.

As a consequence, when the drive voltage rises, the voltage applied to the drive electrode 72 rises gradually so that the ink flow smoothly into the pressure chamber 51. On the other hand, when the drive voltage drops, the voltage is cut off sharply, so that the oscillating plate 55 returns abruptly, thus causing a sharp pressure rise in the pressure chamber 51 and increases the ejection speed of the ink drop.

The drive voltage is applied to the drive electrode 72 by inputting as a basic waveform a drive voltage similar to this pulse waveform to the control circuit 201 and amplifying the drive voltage with the amplifying circuit 203.

Consequently, the voltage application to the drive electrode 72 for printing a single dot is done by first applying the preliminary voltage and applying the drive voltage after a certain time period as shown in FIG. 4C.

For example, in case of an ink jet head equipped with several nozzles so that a multiple dots can be printed at once, the first electrode 56 provided on the oscillating plate 55 serves as a common electrode for all of the nozzles 54, while the drive electrode 72 is provided independently for each nozzle 54.

In case of such an ink jet head, the preliminary voltage is applied to all drive electrodes 72 that correspond to all the nozzles. Therefore, it means that the preliminary voltage is applied to certain nozzles even when printing is not being performed (when the drive voltage is not applied).

By applying the preliminary voltage to all drive electrode regardless of whether printing is performed or not, the applied amount of the drive voltage (applied voltage value), can be determined based on the residual electrical charge after applying the preliminary voltage, so that a constant number of dots can be printed all the time regardless of the length of the non-action time of the ink jet head.

In case of the first embodiment, +22 V is chosen as the drive voltage with a margin considering the fact that the preliminary voltage is +5 V and the voltage required to make the oscillating plate 55 to contact the drive electrode 72 is 20 V.

The specified time from the preliminary voltage application to the drive voltage application is designed to be always constant in this first embodiment. This specified time is chosen to be a time span that does not allow the residual electric charge to be erased by the preliminary voltage after the preliminary voltage is applied, although the appropriate time can vary with the structure of the ink jet head, particularly, the sizes of the space 71 and the electrodes. It is preferable to set the specified time around form 10 to 250 micro seconds.

This is due to the fact that it is undesirable if the specified time is less than 10 micro seconds since this time period causes an excessive charge accumulation, which results in an excessive deformation of the oscillating plate when the drive voltage is applied and in excessively large dot diameters, while it is equally undesirable if the specified time exceeds 250 micro seconds as since this time period causes an excessively low amount of charge, resulting in excessively small deformation after such a printer is used for a long period of time and in excessively small dot diameters.

The electric charge on the oscillating plate can be controlled to an appropriate amount that prevents any fluctuation of the displacement of the oscillation plate (i.e., fluctuation of dot diameters) by maintaining the specified time within from 10 to 250 micro seconds.

This also has an effect of erasing the drive hysteresis. The specified time in this first embodiment is chosen to be 50 micro seconds as shown in FIG. 4C.

Let us now describe briefly how the above-described ink jet head can be manufactured.

The ink jet head 31 utilized in the first embodiment can be manufactured by means of the semiconductor manufacturing process, the micromachine manufacturing process, and the like. Although there many manufacturing methods, let us describe a typical case.

It goes without saying that an ink jet head manufactured by a method not mentioned here can be driven by the drive unit according to this invention.

The ink jet head 31 shown in FIG. 1 comprises the following three components.

The ink jet head 31, as shown in FIG. 1, comprises the channel plate 50 comprising the pressure chamber 51, ink supply chamber 52, inlet 53, nozzle 54 and oscillating plate 55, a top plate 60 that covers the upper side of the channel plate 50, and a glass substrate 70 that has a drive electrode 72 provided in a position to oppose the oscillating plate 55 on the channel plate 50 across a space 71.

Let us now describe the formation of the channel plate 50.

First of all, the channel plate 50 is formed using a silicon substrate lapped to the roughness of about 100 $\mu$m.

Figure 5A:
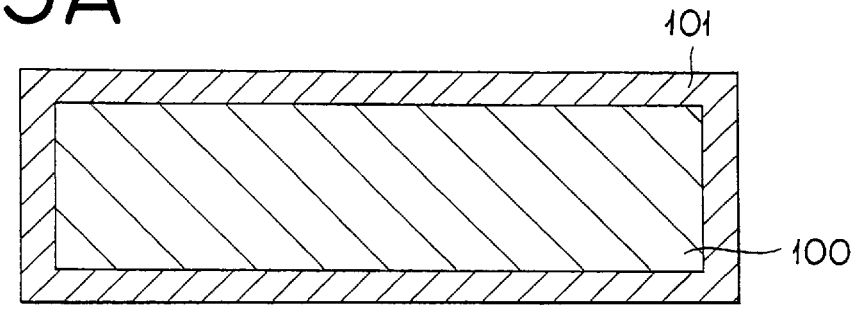
FIGS. 5A, B, and C are cross sections showing the process of manufacturing the ink jet head.
Figure 5B:
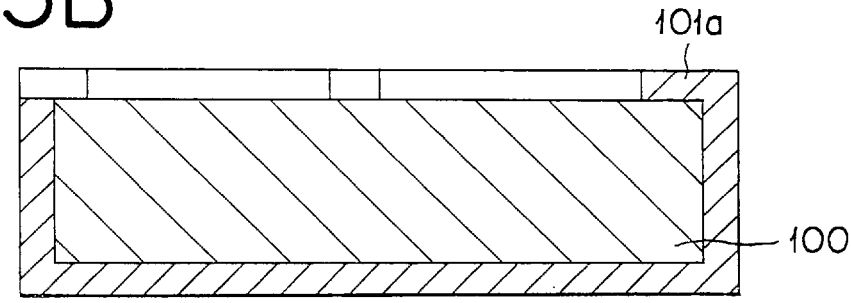

As shown in FIG. 5A, an oxide film 101 is formed by the thermal oxidizing method covering the entire surface of the silicon substrate 100. Using the known methods such as photolithography and dry etching, openings that define the shapes of the pressure chamber 51, ink supply chamber 52, inlet 53 and nozzle 54 are formed on the oxide film 101 on the top surface of the silicon substrate 100 to create an etching mask 101*a* as shown in FIG. 5B.

Next, the silicon substrate 100 having the etching mask 101*a* is anisotropically etched in a KOH solution. The silicon substrate 100 used here has the (1, 1, 0) surface and the (1, 0, 0) surface on the substrate surface. This anisotropic etching with the KOH solution terminates automatically when the (1, 1, 1) surface of the silicon substrate is exposed, so that it is possible to adjust the etching depth to the desired depth in this area by adjusting, during the formation of the etching mask 101*a*, the size of the openings which are to become the nozzle 54 and inlet 53.

The depths of the pressure chamber 51 and ink supply chamber 52, as well as the size of the openings, are adjusted by means of adjusting the etching time so that the thickness of the area to become the oscillating plate 55 to be about 6.5 $\mu$m. This KOH solution etching produces properly tapered surfaces on the side walls of the pressure chamber 51 and ink supply chamber 52 due to the exposure of the (1, 1, 1) surface. The oxide film, which was used as the etching mask, is removed later.

Figure 5C:
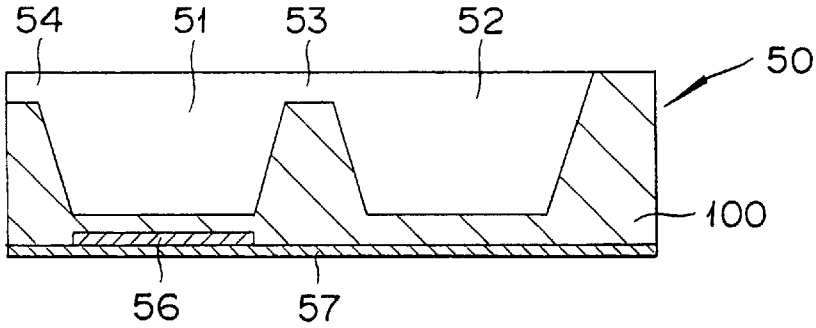
Figure 6:
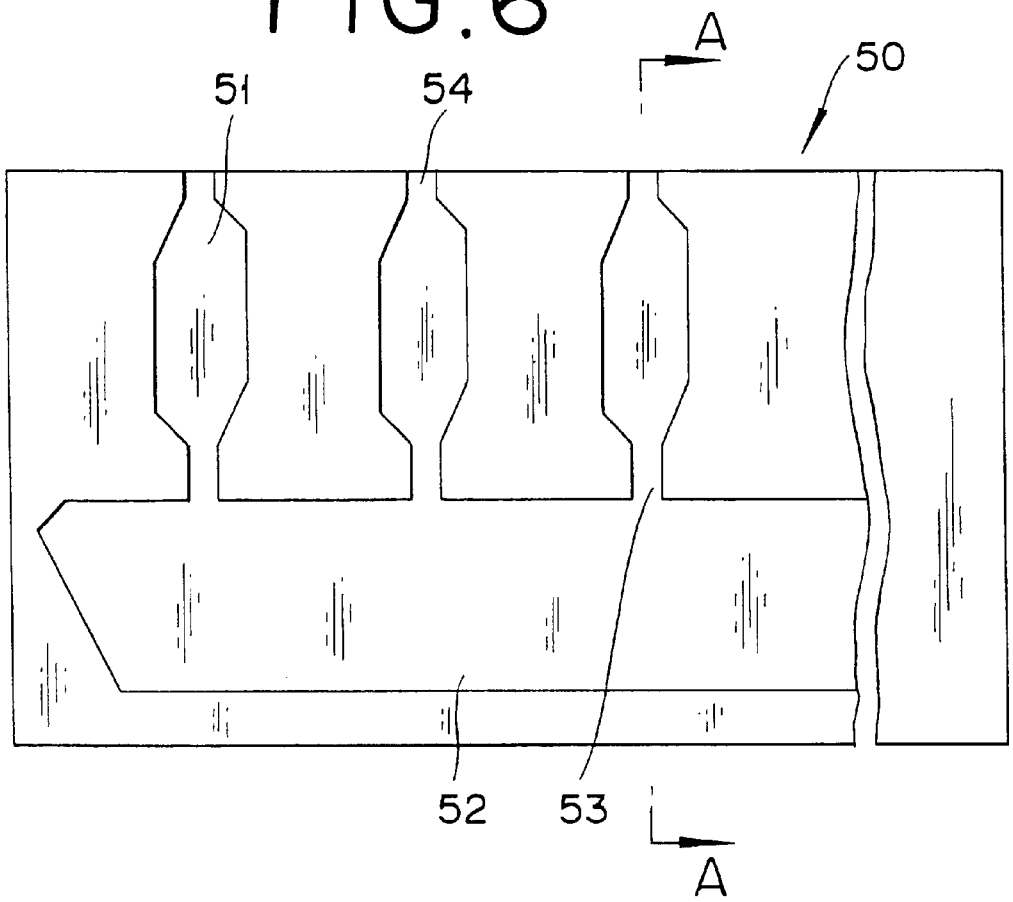
FIG. 6 is a plan view of a channel plate provided in the ink jet head.

Thus, as shown in FIG. 5C and FIG. 6, the pressure chamber 51, ink supply chamber 52, inlet 53, nozzle 54 and oscillating plate 55 are formed on the silicon substrate 100. The channel plate 50 thus formed has multiple pressure chambers and nozzles as shown in FIG. 6, so that multiple ink drops can be ejected simultaneously from a single head.

FIG. 6 is a plan view of the surface of the silicon substrate comprising the pressure chamber 51, ink supply chamber 52, inlet 53, and nozzle 54, and FIG. 5 is a drawing showing a section along the A—A line of FIG. 6.

On the backside of the silicon substrate 100, a resist pattern is formed by means of photolithography comprising openings for the oscillating plate 55 and for an area (not shown) of electrical contact with the first electrode 56. Boron is ion-injected into the oscillating plate 55 and the contact area to form the first electrode 56 and an impurity diffusion layer that becomes a contact line as shown in FIG. 5C. Then, an oxide film is formed on the entire surface of the silicon substrate 100 by means of a thermal oxidation process to form a an insulation film 57 on the surface (backside of the silicon substrate) of the oscillation plate 55. This insulation film 57 is to prevent the shorting with the drive electrode 72.

Figure 8:
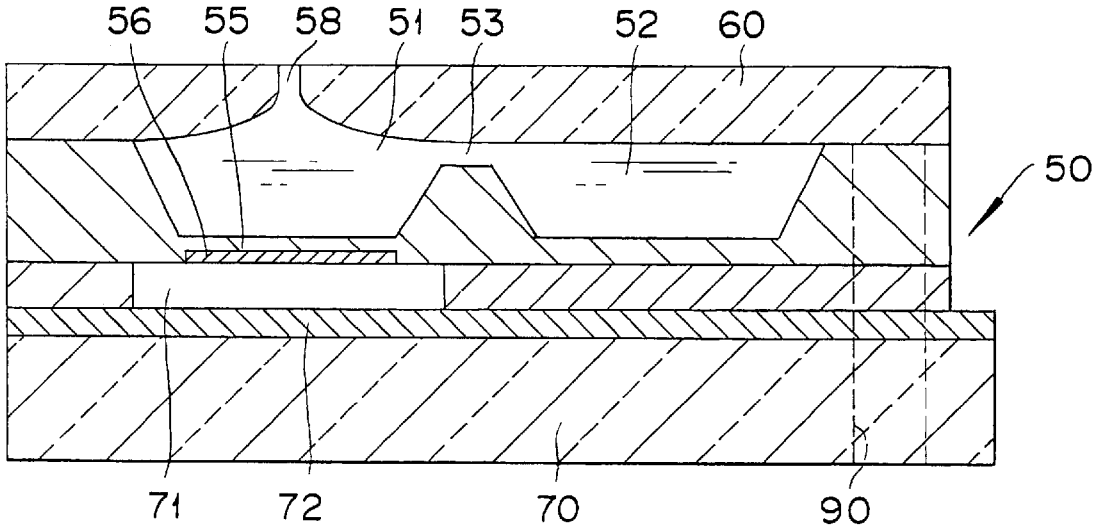
FIG. 8 is a cross section showing an ink jet head of the third embodiment.

Next, let us describe the formation of the glass substrate 70 provided with the drive electrode 72 shown in FIG. 8.

This glass substrate 70 is made from a borosilicate glass substrate. A cavity of a specified depth is formed by etching at a position on the glass substrate 70 which faces the oscillating plate 55 of the channel plate 50 when the glass substrate 70 is joined in the state as shown in FIG. 1, and an ITO film is formed in the overall surface of the substrate 70 including the cavity, thus forming the driving electrode 72 in the cavity and the contact line which connects with the drive electrode 72 on the surface of the substrate by the lift off method. In case of an ink jet head with multiple pressure chambers and nozzles, each pressure chamber has its own drive electrode and its own contact line formed.

Next, a SiFH film of a thickness of about 1 $\mu$m is formed on the entire surface of the surface where the electrode is formed. This SiFH film is not patterned but rather formed on the entire surface of the substrate. This will prevent deterioration of the drive electrode due to ambient humidity.

The depth of the cavity must be such that the distance from the first electrode 56 (insulation film surface) to the opposing drive electrode 72 (SiFH film surface) in the space 71 when the drive electrode 72 is formed is form 0.1 to 1 $\mu$m, or more preferably form 0.1 to 0.5 $\mu$m, so that a lower drive voltage can be used for driving the electrode. In case of the present first embodiment, the cavity is formed in such a way that the space 71 is 0.3 $\mu$m thick as mentioned above.

The space 71 can be formed by digging the silicon substrate 100 from the back surface of the silicon substrate 100 (bottom side in the drawing) in the oscillating plate 55 area of the silicon substrate 100 by means of etching, instead of forming the cavity in the glass substrate 70.

In such a case, no cavity is formed in the glass substrate 70 but rather the drive electrode 72 and the contact line of the drive electrode 72 may be formed by means of ITO.

Next, an ink supply port (not shown) is formed in the top plate 60 made of a borosilicate glass substrate for introducing ink from the ink cassette into the upper area of the pressure chamber 52.

The channel plate 50, the glass substrate 70 and the top plate 60 formed as described above are then anode jointed to form a sandwich structure as shown in FIG. 1, and wires are connected to the contact line made of an impurity diffusion layer formed on the oscillating plate 55 and the contact line formed in the glass substrate 70 respectively to complete the ink jet head.

While the material of the channel plate 50 in the first embodiment was described as silicon, glass, ceramics, metals, resins, sensitizing resins and others can be used as long as they can form the basic shape of the pressure chamber 51.

Let us now describe about the ink used in the present first embodiment.

The composition of the ink used in this embodiment is as shown in Table 1 and consists of four kinds of ink, i.e., black (K), yellow (Y), magenta (M) and cyan (C), each color being adjusted with dyes, where dyes can be replaced by pigments.

TABLE 1

| Composition | Color | | | |
|---|---|---|---|---|
| | K | Y | M | C |
| Distilled water | 82.5 | 82.5 | 82.5 | 82.5 |
| Dye (other pigments can be used) | B/BK-SP Bayer Ltd. 4.6 | B/CA-Y Bayer Ltd. 2.5 | F/R-FF 3282 BASF 2.5 | B/CY-BG Bayer Ltd. 3.0 |
| Diethylene glycol | 3.0 | 3.0 | 3.0 | 3.0 |
| Glycerin | 5.3 | 6.6 | 7.4 | 6.9 |
| Triethylene glycol monobutyl ether | 4.0 | 4.0 | 4.0 | 4.0 |
| Surfactant olefin E1010 by Nisshin Chemical Industry | 0.2 | 1.0 | 0.2 | 0.2 |
| pH adjusting agent $NaHCO_3$ | 0.2 | 0.2 | 0.2 | 0.2 |
| Stabilizing agent triethanol amine | 0.2 | 0.2 | 0.2 | 0.2 |

(Numbers: weight %)

According to this embodiment, the residual electric charges on the first and/or second electrodes can be made constant by forcibly charging electric charges on the electrodes by means of applying the preliminary voltage, so that the ink ejection amount and the ejection speed can be maintained constant regardless of the ink jet head's operating status and history.

As the specified time is chosen to be from 10 to 250 micro seconds, the drive voltage can be applied before the accumulated electric charges disappear after the preliminary voltage is applied and the amount of the drive voltage application can be determined based on the original conditions of the electric charges on the first and/or second electrodes, so that the ink ejection amount and the ejection speed can be maintained constant regardless of the ink jet head's operating status and history.

[Second Embodiment]

The second embodiment is designed in such a way that the specified time between the preliminary voltage application to the drive voltage application as described in the first embodiment is changed according to the relative humidity in the vicinity of the ink jet head.

Since the constitution of the ink jet head and the constitution of the drive circuit except the control based on the humidity are the same as those of the first embodiment, the descriptions of these constitutions shall not be repeated here.

The reason the specified time is determined according to the humidity in the vicinity of the ink jet head is that the disappearing speed of the electric charges accumulated on the electrodes varies with the humidity in the vicinity of the ink jet head.

In the second embodiment, therefore, a humidity sensor is provided in the vicinity of the ink jet head so that the specified time from the preliminary voltage application to the drive voltage application is determined based on the signal from this humidity sensor. Using the relative humidity of 70% as the divide, the specified time is set at from 10 to 100 microseconds if the relative humidity is higher than 70%, while the specified time is set at from 100 to 250 micro seconds if the relative humidity is lower than 70%, or from 100 to 500 micro seconds if the relative humidity is extremely low.

This is to compensate for the fact that, if the relative humidity is higher than 70%, the electric charges accumulated on the electrodes tend to be dissipated more quickly due to high humidity if the relative humidity is higher than 70% so that by shortening the specified time a constant amount of charges can be kept accumulated always when the drive voltage is applied.

The reason the specified time is set at from 10 to 100 micro seconds is as follows.

If the specified time is shorter than 10 micro seconds, the accumulated charges become too much so that the displacement of the oscillation plate becomes excessive when the drive voltage is applied, which results in an undesirable situation where the dot diameters being too large. Another reason for this is that the discharge of the accumulated electrical charges is saturated and can not change if the specified time is less than 10 micro seconds regardless of the humidity.

On the other hand, if the specified time is chosen longer than 100 micro seconds, the charges accumulated by the preliminary voltage application disappear completely due to high humidity, so that it is made impossible to maintain the state that a constant amount of charges is always accumulated by applying the preliminary voltage.

The reason that the specified time is changed using the relative humidity of 70% as the divide is as follows.

If the relative humidity is less than 70%, the charges accumulated on the electrodes cannot be dissipated easily due to dry air so that the specified time is chosen longer to let a certain amount of the charges accumulated by the preliminary voltage application be dissipated and that it is made possible to apply the drive voltage in the state that a constant amount of charges is always accumulated.

If the specified time is shorter than 100 micro seconds, most of the accumulated charges remain intact due to the low relative humidity, causing an undesirable condition of high charges. On the other hand, if the specified time is chosen longer than 500 micro seconds, the amount of the accumulated charges is too low so that the displacement becomes too small and the dot diameters become too small, which is undesirable if this drive unit is used for a printer.

It is thus possible to control the amount of accumulated electric charges to prevent the fluctuation of the displacement of the oscillating plate (i.e., the fluctuation of the dot diameter) by adjusting the specified time according to the humidity. This also contributes to the elimination of the drive hysteresis.

Figure 7:
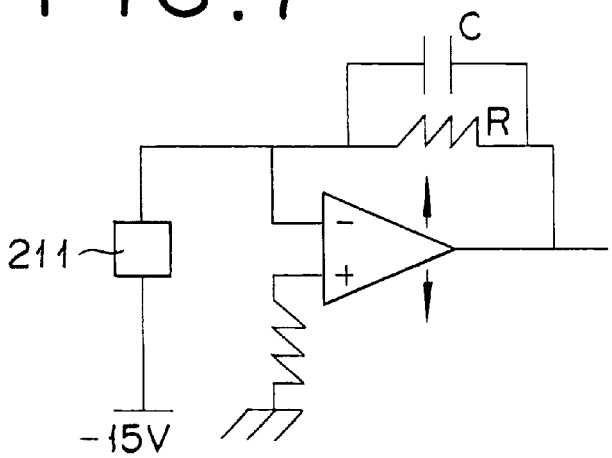
FIG. 7 is a circuit diagram of a humidity sensor used in a drive circuit for an ink jet head of the second embodiment.

More specifically, the relative humidity in the vicinity of the ink jet head is detected by a humidity sensor 211 arranged near the ink jet head to output a voltage relative to the detected humidity by the circuit shown in FIG. 7, while a control circuit 201 shown in FIG. 2 determines based on the output voltage whether the relative humidity has exceeded a certain value, 70% in this case, and sets the specified time at from 10 to 100 micro seconds if the voltage is above the value equivalent to the humidity of 70%, or sets the specified time at from 100 to 500 micro seconds if the voltage is below the value equivalent to the humidity of 70%.

The humidity sensor can be a digital humidity sensor rather than this analog humidity sensor.

The amount of ink drop ejection and the ejection speed can be held constant regardless of the temperature and humidity in the vicinity of the ink jet head by determining the specified time according to the relative humidity in the vicinity of the ink jet head, thus being able to suppress the occurrence of image fluctuations due to environmental changes.

While the specified time is changed using the relative humidity of 70% as the standard in the second embodiment, it is also possible to change the specified time by setting multiple standards with an increment of 10%, 20% or 30%.

[Third Embodiment]

The third embodiment is different from the first embodiment only in the ink jet head structure shown in FIG. 1, and the constitution of the drive unit is the same as in the first embodiment or the second embodiment.

FIG. 8 is a cross section showing the constitution of an ink jet head used in the present third embodiment.

This ink jet head 32 is essentially the same in constitution as the ink jet head 31 used in the first embodiment except that the location of the nozzle for ejecting ink drops is provided at the top of the drawing.

The ink jet head 32 comprises a nozzle 58 provided at the top of the drawing, a pressure chamber 51 equipped with an oscillator plate 55 for changing the inner pressure to cause ink to be ejected through the nozzle 58, an ink supply chamber 52 where ink is stored to supply ink to the pressure chamber 51, an inlet 53 that introduces the ink in the ink supply chamber 52 into the pressure chamber, and a drive electrode 72 located opposing the oscillating plate 55 across a space 71.

Same as in the first embodiment, a first electrode 56 is formed on the oscillating plate 55 by diffusing boron, and a voltage is applied across the first electrode 56 and the drive electrode 72, or a second electrode, to cause the oscillating plate 55 to deform, consequently changing the internal pressure of the pressure chamber 51 so as to eject ink drops through the nozzle 58. The nozzle 58 points downward when the ink jet head 32 is actually used.

The ink jet head 32 is manufactured by using the same method as employed in manufacturing the ink jet head 31 described above except that the nozzle 58 is formed on the top plate 60 using the known Ni electrocasting method and that the ink supply port 90 is formed from the side of the glass substrate 70.

This ink jet head 32 prints on the recording paper with the nozzle 58 pointing downward when the ink jet head 32 is actually used.

By having the nozzle 58 on the top of the drawing, i.e., at a position to oppose the oscillating plate 55, the ink water head (pressure) in the pressure chamber 51 generated by the deformation of the oscillating plate 55 aligns with the direction of the ink ejection direction, thus assisting the ink ejection and providing the same ejection speed with a smaller deformation of the oscillating plate 55 in comparison with the constitution of the first embodiment.

Also, by arranging the nozzle 58 at the position opposing the oscillating plate 55 as mentioned above, the pressure applied to each nozzle becomes uniform when multiple nozzles are provided in a single head.

When this ink jet head 32 ejects ink drops using a drive circuit similar to the drive circuit 200 described in reference to the first and second embodiments, the required drive voltage is only 18 V. Therefore, it is possible to lower the absolute value of the drive voltage by providing a nozzle at a position opposing the oscillation plate 55.

[Fourth embodiment]

The fourth embodiment is an ink jet recording apparatus of the present invention comprising an ink jet head according the first embodiment and a drive circuit equipped with humidity sensor mentioned in the second embodiment.

Figure 9:
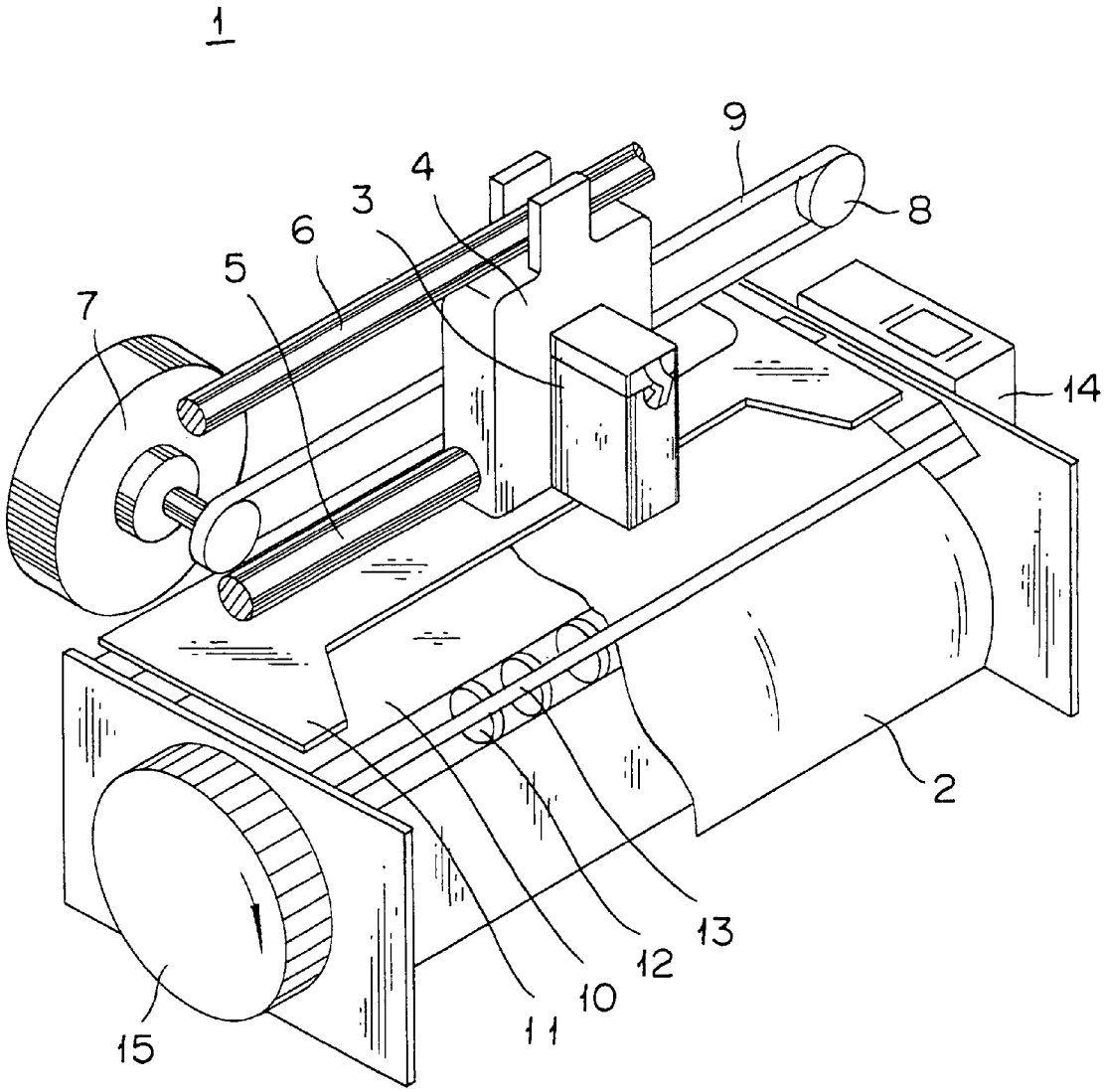
FIG. 9 is a perspective view for describing the outline structure of an ink jet printer equipped with the drive unit of the ink jet head according to the present invention.

FIG. 9 is a perspective view describing the general constitution of an ink jet printer 1.

The ink jet printer 1 is used for printing on a recording sheet 2, which is a recording medium such as paper and OHP sheet, and comprises an ink jet head scanning system and a recording sheet feed system.

The ink jet head scanning system comprises a head unit 3 that consists of ink jet type print heads for seven colors, a carriage 4 that holds the head unit 3, a scan shaft 5 and a guide shaft 6 that help the carriage 4 shuttle in parallel to the recording surface of the recording sheet 2, a pulse motor 7 that causes the carriage 4 to shuttle along the guide shaft 6, an idle pulley 8 that converts the rotation of the pulse motor 7 to a reciprocating linear motion of the carriage 4, and a timing belt 9.

The recording sheet feeding system comprises a platen 10 that serves as the guide plate for guiding the recording sheet 2 along the transport passage the recording sheet 2, a paper hold down plate 11 that prevents the recording sheet 2 from floating randomly between the paper hold down plate 11 and the platen 10, a discharge roller 12 for discharging the recording sheet 2, a discharged paper hold down roller 13, a maintenance unit 14 for restoring the ink ejecting nozzle surface of the head unit 3 to the original good condition, and a paper feed knob 15 for transporting the recording sheet 2 manually.

The recording sheet 2 is fed into a recording area where the head unit 3 and the platen 10 are opposing to each other by means of manual feeding or a paper feeding unit such as a cut sheet feeder. The number of revolutions of the paper feeder (not shown) in this case is under control in order to control the transportation in the recording area. The paper feed roller is driven by a paper feed motor (not shown).

The ink jet head 3 described in detail in the first embodiment is used for the print head of the head unit 3, and ink drops ejected from this ink jet head 31 land on the recording sheet 2 to form images. The present embodiment can also be implemented using the ink jet head 32 of the third embodiment instead of the ink jet head 31 of the first embodiment.

The carriage 4 performs the main scanning by moving the head in a direction perpendicular to the direction of conveyance of the recording sheet by means of the pulse motor 7, idle pulley 8, and timing belt 9, and the head unit 3 mounted on the carriage 4 records the image for one line. When the recording of the image for one line is completed, the recording sheet 2 is fed for one line in the direction of conveyance of the recording sheet to perform the subscanning and the recording of the next line is conducted.

Thus, the image is recorded on the recording sheet 2, and the recording sheet 2 that has passed the recording area is discharged by the discharge roller 12 provided on the downstream side of the transport direction with the help of the discharge paper hold down roller 13 that maintains contact with the former under a constant pressure.

Figure 10:
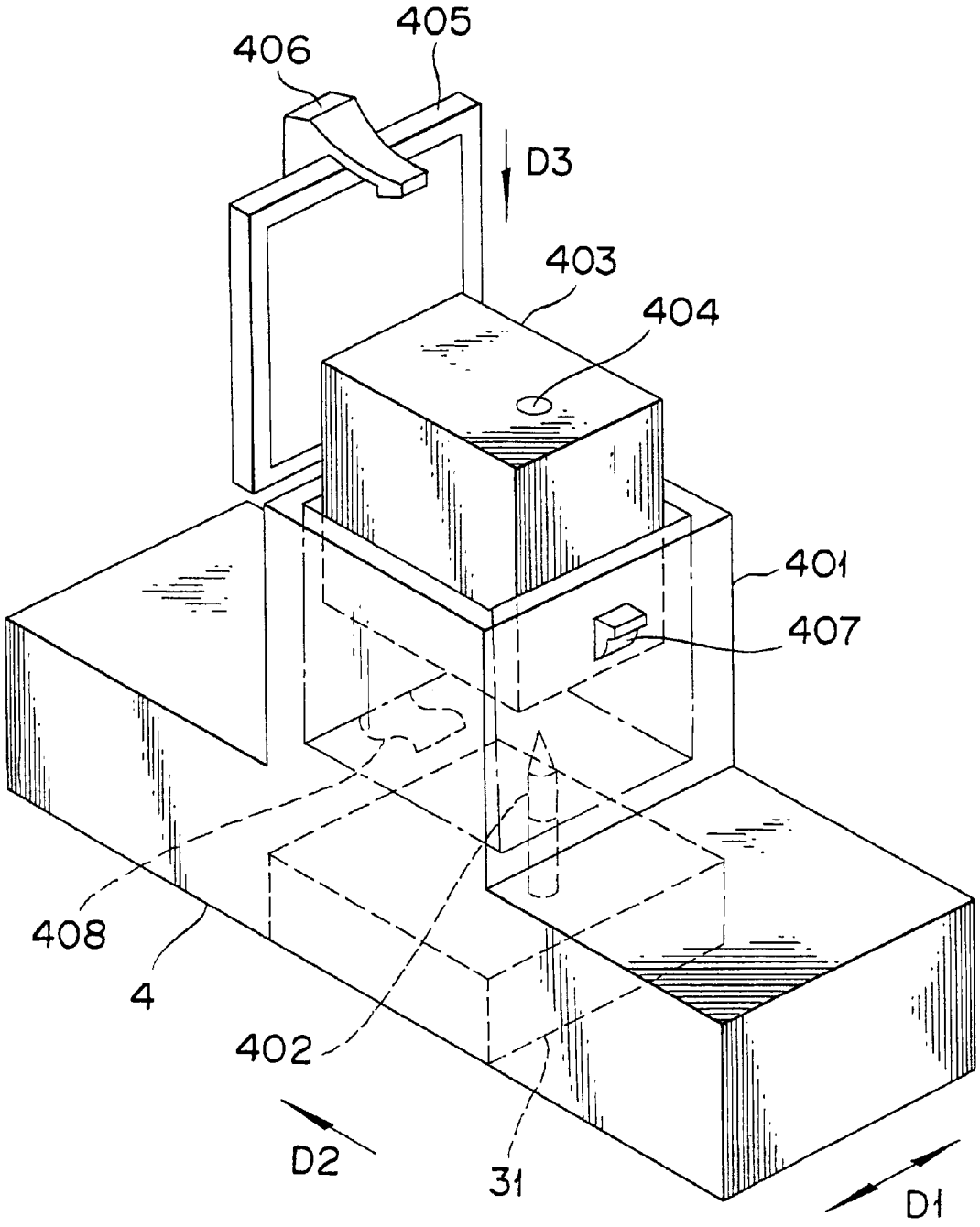
FIG. 10 is a perspective view of the constitution surrounding a carriage of the ink jet printer.

FIG. 10 is a perspective view for describing the constitution in the vicinity of the carriage 4 including the ink jet head 31 for one color of the head unit 3 indicated in FIG. 9.

Provided in the vicinity of the carriage 4 are an ink cartridge 403 that stores ink and is equipped with an air vent 404, a casing 401 that contains the ink cartridge 403, a casing lid 405, an ink supply tube 402 that supplies ink to the ink jet head 31 without affecting the detachability of the ink cartridge 403, a hook 406 that affixes the casing lid 405 to the casing 401 when the casing lid 405 is closed, a lid latch 407, and a hold down spring 408 that energizes the ink cartridge 403 in the direction opposite to the direction of storing the ink cartridge 403 (direction of the arrow D3) to keep the ink cartridge 403 between the hold down spring 408 and the casing lid 405 in the casing 401.

When the carriage 4 moves in the scan direction (direction of the arrow D1), the main scanning of the recording sheet 2 is performed. When the recording sheet 2 is fed, printing is performed in the sub scanning direction (direction of the arrow D2).

Figure 11:
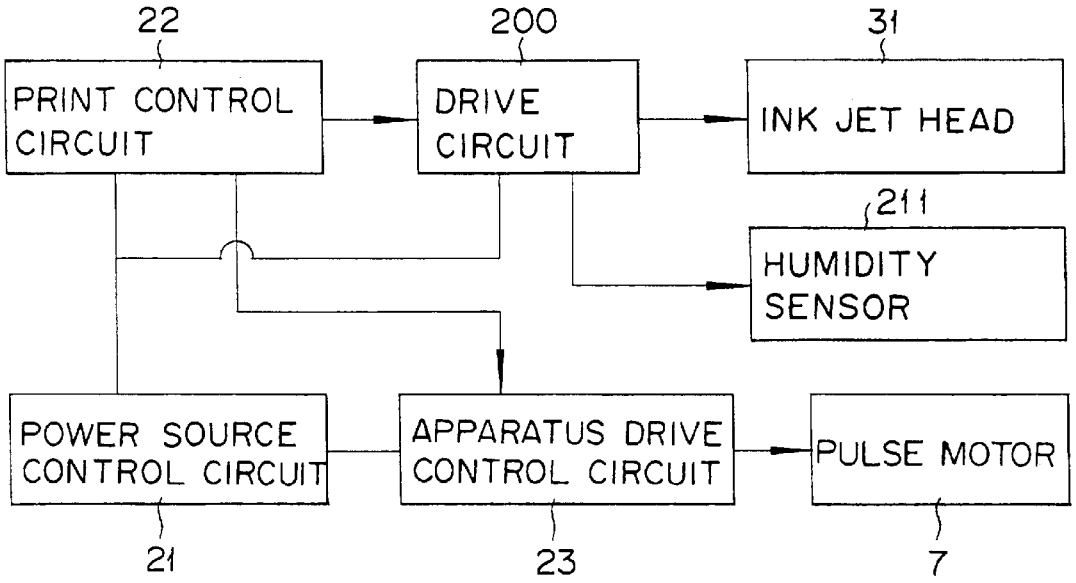
FIG. 11 is a block diagram for describing the constitution of a control system of the ink jet printer, showing the fourth embodiment.

FIG. 11 is a block diagram showing the constitution of a control system of this ink jet printer.

The control system of an ink jet printer comprises a power source control circuit 21 that supplies electric power of a required voltage to various parts of the system, a print control circuit 22 that controls various parts when forming images on the recording sheet, a drive circuit 200 that drives the ink jet head 31 based on the signals from the print control circuit 22, and an apparatus drive control circuit 23 that drives the pulse motor 7 and the paper feed motor (not shown) based on the signals from the print control circuit 22.

The print control circuit 22 receives print data from a computer (not shown), etc., and controls the paper feed and the feed amount of the printer head 3 to reproduce images on the recording sheet 2 based on the print data received, as well as issues the print control signal to the drive circuit 200 for ejecting ink from the ink jet head 31 to record the images in coordination with these motions.

The drive circuit 200 determines the specified time between the preliminary voltage application and the drive voltage application based on the relative humidity by providing a humidity sensor 211 in the drive circuit 200 as shown in FIG. 3, which is similar to the second embodiment. This drive circuit 200, upon receiving the print control signal from the print control circuit 22, activates the pre-pulse generation circuit 202 (see FIG. 3) to cause the control circuit 201 (see FIG. 3) within the drive circuit 200 to generate and apply the pre-pulse, i.e. preliminary voltage on the drive electrode 72.

After the specified time, which is dependent on the relative humidity in the vicinity of the ink jet head, has passed, the drive voltage is applied on the drive electrode 72 based on the humidity sensor 211.

The present embodiment can also be implemented using, instead of the drive circuit 200, the drive circuit without the humidity sensor as described in the first embodiment.

As shown above, it is possible to record and reproduce excellent images unaffected by the fluctuation of the electric changes remaining on the electrodes, particularly on the first electrode provided on the oscillating plate by employing the ink jet heads described in the first and third embodiments and the drive circuits of the first and second embodiments.

[Fifth Embodiment]

The fifth embodiment is a drive unit for driving the ink jet head of the first embodiment described above and applies an AC voltage across the first electrode 56 and the second electrode 72 to suppress the polarization that might occur otherwise on both electrodes.

Figure 12:
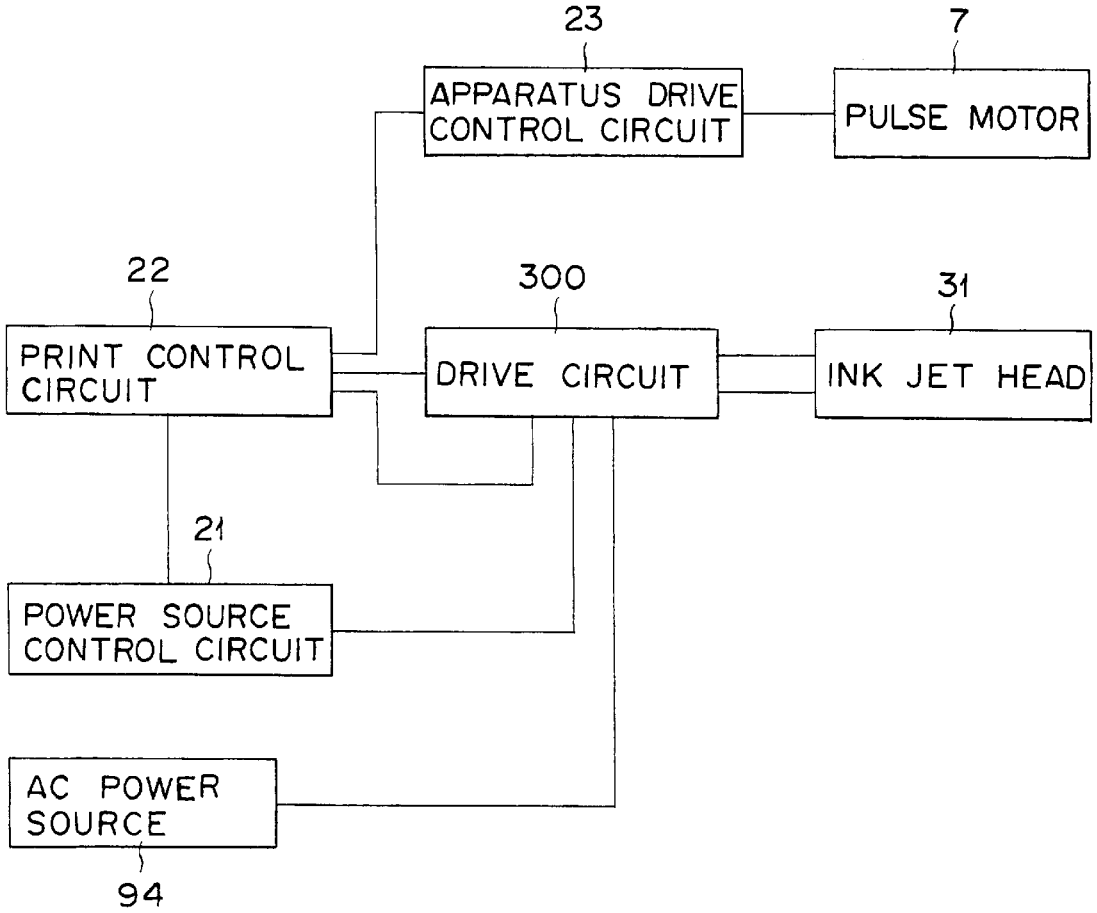
FIG. 12 is a block diagram for describing the constitution of another control system of the ink jet printer, showing the fifth embodiment.

FIG. 12 is a block diagram for describing the constitution of the ink jet printer in the fifth embodiment. The drawing is intended to show primarily the area that concerns the operating control of the ink jet head scanning system. The power control circuit 21, print control circuit 22 and apparatus drive control circuit 23 shown in this drawing function exactly the same way as those in FIG. 11, so that their detailed descriptions are not repeated here.

The pulse motor 7 caused the ink jet head 31 to shuttle along the guide shaft 6 (see FIG. 1) and the operation of the pulse motor 7 is controlled by the apparatus drive control circuit 23 operating based on the instructions of the print control circuit 22.

An AC power source 94 is a power source that provides a low voltage high frequency AC voltage to be applied to the ink jet head 31.

A drive circuit 300 provides a pulse drive voltage based on the power supplied from the power control circuit 21 in order to operate the ink jet head 31 to eject ink, and a low voltage high frequency AC voltage from the AC power source 94 during a period after ink is ejected until the next drive voltage application.

Figure 13:
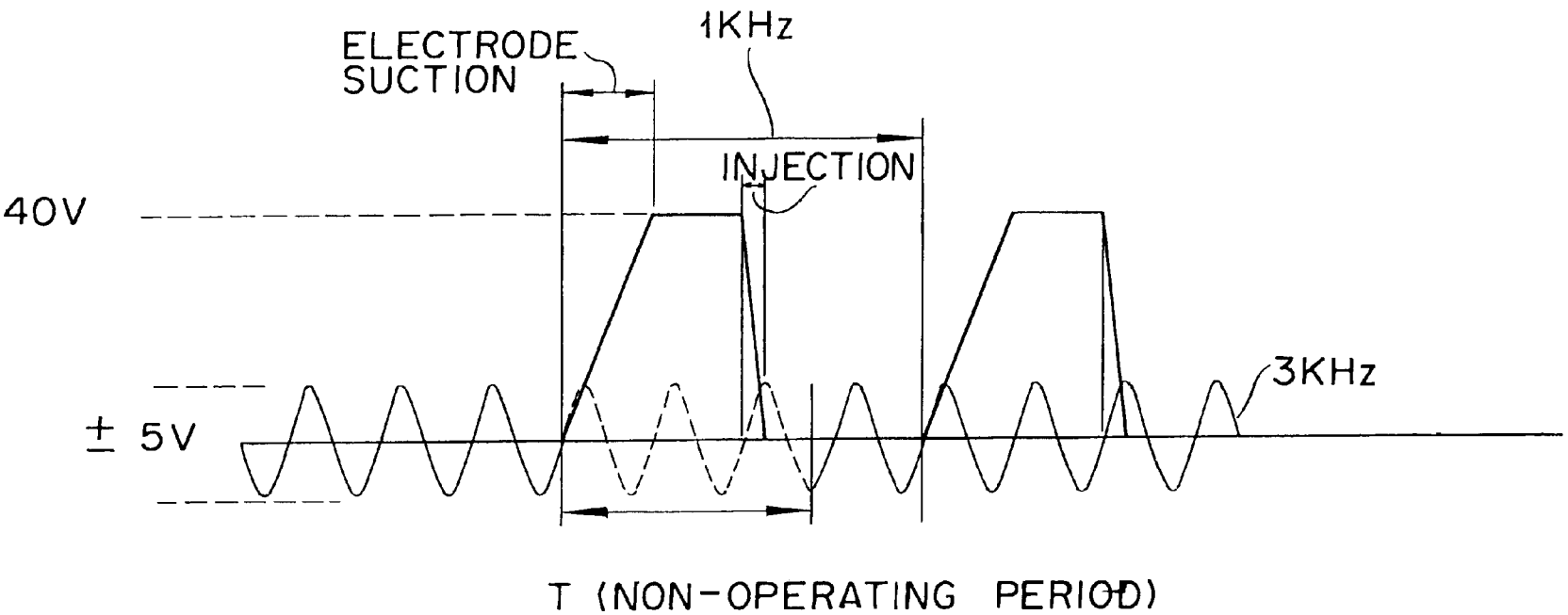
FIG. 13 is a diagram for describing the output waveform of the output from the drive circuit shown in FIG. 3.

The ink jet head 31 has the same construction as the ink jet head used in the first and third embodiments, and a pulse-like drive voltage (e.g., 40 V DC) from the drive circuit 93 is applied to the drive electrode 72 that constitutes the head 31 during the operating period for ink ejection as shown in FIG. 13, while an AC voltage (e.g., 5 V) of 3 kHz to 1 MHz provided by the AC source 94 is applied during the non-operating period, the period other than the period mentioned above.

The reason a low voltage AC such as 5 V is used during the non-operating period is that the oscillating plate 55 can sustain oscillations in vertical direction of FIG. 3 (the AC voltage applied turns the voltage on and off, which results in the oscillation of the oscillating plate 55 as shown in FIG. 2), and that it is therefore necessary to suppress the amplitude (distance) of the oscillation which is proportional to the applied voltage to a degree that does not cause ink ejection from the nozzle 54.

A lower limit of 3 kHz is applied to the frequency of the AC voltage because of the consideration for the pulse cycles of the pulse generated by the drive circuit 300. If the pulse cycle of the drive voltage provided by the drive circuit 300 in this embodiment is 1 kHz, it is impossible to achieve the effect of eliminating the residual electric charges unless making it possible to apply the AC voltage for at least one cycle during the period after the drive voltage for driving the oscillating plate 55 is applied until the next drive voltage application as shown in FIG. 13.

The non-operation period mentioned in the present embodiment means, as shown in FIG. 13, either a time period of a prescribed length (indicated as T in the drawing) after the application of the drive voltage (DC voltage) on the drive electrode 72, a prescribed time after ink is ejected through the nozzle 54, or a prescribed period of time after the carriage stop during the operation of the carriage 4.

The drive unit of the present embodiment is constituted as described above, and specific operations of the drive unit are described below.

When the drive circuit 300 receives a print signal from the print control circuit 22, the drive circuit 300 generates a pulse-like drive voltage as shown in FIG. 13. While the drive circuit 300 is generating this drive voltage output, the first electrode 56 shown in FIG. 1 is grounded and a voltage of about 40 V is applied on the drive electrode 72. As a result, the oscillating plate 55 is attracted toward the drive electrode 72 by the electrostatic force generated between the two electrodes 56 and 72 as shown in FIG. 2A to cause a contact of the oscillating plate 55 with the drive electrode 72. Due to this deformation of the oscillating plate 55, ink flows from the ink supply room 52 into the pressure chamber 51 through the inlet 53.

After the pressure chamber 51 is filled with ink sufficiently, the drive voltage is turned off as shown in FIG. 13. As a result, the electrostatic force between the electrodes 56 and 72 disappear and the oscillating plate 55 returns to the original state due to its own restoring force, and ink is ejected through the nozzle 54 caused by the volumetric change of the pressure chamber 51.

The drive circuit 300 switches to the AC power source 94 after ink has been ejected through the nozzle 54 and the oscillation of the oscillation plate 55 has subsided, and applies a low voltage (5 V) high frequency (approximately 3 kHz–1 MHz) across the first electrode 56 and the driving electrode 72 as shown in FIG. 13. The residual electric charges remaining on the electrodes 65 and 72 are discharged through the AC power source 94 due to this AC power application.

In other words, the AC voltage is kept applied except during the period from the time when the pulse-like drive voltage is applied on the drive electrode 72 with the start of the drive circuit 300 until the ink ejection ends. This AC voltage application is continued until the drive voltage is applied from the drive circuit 93 next time. The same operation as above is then repeated.

Since the AC voltage is constantly applied on the oscillating plate 55 constantly during the non-operating period of the head, it means that the oscillating plate 55 is constantly oscillating and this motion causes churning of the ink in the pressure chamber 51, which contributes to the continuous elimination of the residual electric charge and to a more stable ink ejection from the nozzle.

The best timing for the drive voltage application on the drive electrode 72 is preferably when the applied AC voltage turns from negative to positive. Because, if such a timing is set, the oscillating plate 55 can be bent smoothly from the oscillation action of the oscillation plate 55 (due to the DC voltage).

According to this embodiment, since a low voltage high frequency AC voltage of a level that does not cause ink ejection is applied across the first electrode and the drive electrode during the non-operating period of the ink jet head, the residual electric charge can be completely eliminated and the chance of polarization can be suppressed so that a stable amount of ink can be ejected from the nozzle.

Since the frequency of the ac voltage applied across the first electrode and the drive electrode is chosen to be higher than the frequency of the pulse applied on the drive electrode during the operation of the ink jet head, the residual electrical charge can be effectively eliminated.

What is claimed is:

1. An ink jet recording apparatus comprising:

an oscillating plate which has a resilient characteristic and faces a pressure chamber that communicates with a nozzle;

a first electrode provided on said oscillating plate;

a second electrode provided opposing said first electrode across a space; and a voltage applier for applying a first voltage pulse for ejecting ink and a second voltage pulse that is not high enough to cause ink ejection, wherein said first and second voltage pulses are each applied across said first and second electrodes.

2. An ink jet recording apparatus of claim 1, wherein said second voltage pulse is applied a specified time prior to an application of the first voltage pulse.

3. An ink jet recording apparatus of claim 2, wherein said specified time is from 10 to 250 microseconds.

4. An ink jet recording apparatus of claim 2, further comprising a humidity detector for detecting humidity, wherein said ink jet recording apparatus determines said specified time based on the detected humidity.

5. An ink jet recording apparatus of claim 4, wherein said specified time is decreased when the detected humidity is higher than a specified value and is increased when the detected humidity is lower than the specified value.

6. A drive unit for an ink jet head for ejecting ink by deforming an oscillating plate by means of applying a voltage pulse between an oscillating plate and an electrode opposing said oscillating plate across a space, said drive unit comprising:

a first voltage applier for applying a first voltage pulse across said oscillating plate and said electrode; and a second voltage applier for applying a second voltage pulse across said oscillating plate and said electrode, wherein the second voltage pulse is not high enough to cause ink ejection.

7. A drive unit of claim 6, wherein said second voltage pulse is applied a specified time prior to an application of the first voltage pulse.

8. A drive unit of claim 7, wherein said specified time is from 10 to 250 microseconds.

9. A drive unit of claim 7, further comprising a humidity detector for detecting humidity to determine said specified time based on the detected humidity.

10. A drive unit of claim 9, wherein said specified time is decreased when the detected humidity is higher than a specified value and is increased when the detected humidity is lower than the specified value.

11. A drive unit of claim 6, wherein a period of the second voltage pulse application is shorter than a period of the first voltage pulse application.

12. A drive method for an ink jet head for ejecting ink by deforming an oscillating plate by means of applying a voltage pulse between an oscillating plate and an electrode opposing said oscillating plate across a space, said drive method comprising the steps of:

applying a preliminary voltage pulse that is not high enough for ejecting ink; and applying a drive voltage pulse for ejecting ink, wherein said preliminary voltage pulse and said drive voltage pulse are each applied across said oscillating plate and said electrode.

13. A drive method for an ink jet head of claim 12, wherein said preliminary voltage pulse is applied a specified time prior to an application of the drive voltage pulse.

14. A drive method for an ink jet head of claim 13, wherein said specified time is from 10 to 250 microseconds.

15. A drive method for an ink jet head of claim 13, wherein humidity is detected prior to the application of said preliminary voltage pulse and said specified time is determined based on the detected humidity.

16. A drive method for an ink jet head of claim 15, wherein said specified time is decreased when the detected humidity is higher than a specified value and is increased when the detected humidity is lower than the specified value.

17. A drive method for an ink jet head of claim 12, wherein a period of the drive voltage pulse is shorter than a period of the preliminary voltage pulse.

18. A drive unit for an ink jet head for ejecting ink by deforming an oscillating plate by means of applying a voltage pulse between an oscillating plate and an electrode opposing said oscillating plate across a space, said drive unit comprising:

a drive voltage controller for applying a voltage pulse across said oscillating plate and said electrode; and an AC voltage controller for applying an AC voltage across said oscillating plate and said electrode, wherein said AC voltage is applied when said voltage pulse is not being applied.

19. A drive unit for an ink jet head of claim 18, wherein said AC voltage is not so high as to cause ink ejection.

20. A drive unit for an ink jet head of claim 18, wherein a frequency of said AC voltage is higher than a frequency of the voltage pulse.

21. A drive unit for an ink jet head of claim 18, wherein said AC voltage controller applies at least one wavelength of AC voltage between a voltage pulse application and a next voltage pulse application.

22. A drive unit for an ink jet head of claim 18, wherein said voltage pulse is applied at a timing when the AC voltage turns from negative to positive.

23. A drive method for an ink jet head for ejecting ink by deforming an oscillating plate by means of applying a voltage pulse between an oscillating plate and an electrode opposing said oscillating plate across a space, said drive method comprising the steps of:

applying an AC voltage across said oscillating plate and said electrode when said voltage pulse is not being applied; and applying said voltage pulse across said oscillating plate and said electrode for ejecting ink.

24. A drive method for an ink jet head of claim 23, wherein said AC voltage is not so high as to cause ink ejection.

25. A drive method for an ink jet head of claim 23, wherein a frequency of said AC voltage is higher than a frequency of the voltage pulse.

26. A drive method for an ink jet head of claim 23, wherein at least one wavelength of AC voltage is applied between a voltage pulse application and a next voltage pulse application.

27. A drive method for an ink jet head of claim 23, wherein said voltage pulse is applied at a timing when the AC voltage turns from negative to positive.

28. An ink jet print head adapted for use in an ink jet printer, said ink jet print head comprising:

a nozzle;

an ink chamber in communication with said nozzle;

an electrostatic actuator comprising:

an oscillating plate provided in a part of said ink chamber, and an electrode opposing said oscillating plate across a space; and a driver for controlling said electrostatic actuator, wherein said driver selectively applies at least two different pulses across said oscillating plate and said electrode, said at least two different pulses including a first pulse sufficient for ejecting ink from said ink chamber through said nozzle, and said at least two different pulses including a second pulse insufficient for ejecting ink from said ink chamber through said nozzle.

29. An ink jet print head in accordance with claim 28, wherein said at least two different pulses includes a plurality of drive pulses sufficient for ejecting ink from said ink chamber through said nozzle, wherein said first pulse is one of the plurality of drive pulses, and said at least two different pulses includes an AC signal, wherein said second pulse is a portion of said AC signal.

30. An ink jet print head in accordance with claim 29, wherein said AC signal is insufficient for ejecting ink from said ink chamber through said nozzle, and wherein said driver applies said AC signal across said oscillating plate and said electrode between each of said plurality of drive pulses.

31. An ink jet print head in accordance with claim 28, wherein said at least two different pulses includes a plurality of drive pulses sufficient for ejecting ink from said ink chamber through said nozzle, wherein said first pulse is one of the plurality of drive pulses, and said at least two different pulses includes a plurality of discharge pulses, wherein said second pulse is one of the plurality of discharge pulses.

32. An ink jet print head in accordance with claim 31, wherein each of said plurality of discharge pulses is insufficient for ejecting ink from said ink chamber through said nozzle.

33. An ink jet print head in accordance with claim 28, wherein said second pulse is applied a specified time prior to an application of said first pulse.

34. An ink jet print head in accordance with claim 33, further comprising a humidity detector for detecting humidity in the vicinity of the ink jet print head, wherein said driver determines said specified time based on the thus detected humidity.

* * * * *